United States Patent [19]

Kirsinas et al.

[11] Patent Number: 4,489,589

[45] Date of Patent: Dec. 25, 1984

[54] AUTOMATIC WIRE JOINT INSTALLATION TOOL

[75] Inventors: Peter Kirsinas, Country Club Hills; John J. Brouwer, Lansing; Richard M. Purpura, Park Forest; Donald C. Wiencek, Crestwood, all of Ill.

[73] Assignee: Panduit Corp., Tinley Park, Ill.

[21] Appl. No.: 392,966

[22] Filed: Jun. 28, 1982

[51] Int. Cl.[3] ..... B21D 43/02

[52] U.S. Cl. ..... 72/424; 29/753; 29/816; 221/236

[58] Field of Search ..... 72/424; 29/751, 753, 29/759, 809, 816; 227/116, 115, 114; 221/236, 238, 251; 140/93.2, 93.4, 52, 53

[56] References Cited

U.S. PATENT DOCUMENTS

| | | | |
|---|---|---|---|
| 3,094,349 | 6/1963 | Schwalm | 294/114 |
| 3,460,230 | 8/1969 | Moulin | 29/753 |
| 3,517,856 | 6/1970 | Ginther | 221/236 |
| 3,653,117 | 4/1972 | Wolfberg et al. | 29/816 |
| 3,733,883 | 5/1973 | Kaczmarek | 29/816 |
| 3,988,102 | 10/1976 | Bakermans et al. | 29/816 |
| 4,114,253 | 9/1978 | Loomis et al. | 29/566.2 |
| 4,236,302 | 12/1980 | Kuehling | 29/753 |

OTHER PUBLICATIONS

WAC Brochure—WAC OEM Wire Connectors—Aug. 1978.

Tool Engineers Handbook—2nd Edition, (pp. 11-25 and 11-29).

*Primary Examiner*—Lowell A. Larson

*Attorney, Agent, or Firm*—Charles R. Wentzel; Mark D. Hilliard

[57] ABSTRACT

Apparatus for applying wire joints, of the type having a crimpable metallic ferrule, to the ends of wires. The apparatus includes a feeder for holding a supply of the joints, a tool for applying the joints to be crimped, and a conveyor interconnecting the feeder and the tool for conveying the joints in series. The tool has a crimping station and first and second crimping members which are movable between an open position and a crimping position for applying a joint held at the crimping station. The tool also includes a wire joint advance mechanism responsive to the crimping members moving toward their open position to advance the next upstream wire joint to the crimping station thereby ejecting the wire joint applied to the wires.

As a method, the present invention includes the steps of moving a wire joint from a loading station to the crimping station as the crimping members move to their open position. A wire joint is moved from a stack retaining station toward an intermediate station as the crimping members move to their open position. The method also includes the step of moving a wire joint from the intermediate station to the loading station as the crimping members move toward their crimping position so that another wire joint is fed to the crimping station during each cycle of operation of the crimping members.

28 Claims, 20 Drawing Figures

AUTOMATIC WIRE JOINT INSTALLATION TOOL

BACKGROUND OF THE INVENTION

The present invention relates to tools for applying connectors and, more particularly, to an automatic tool for joining wires using wire joints.

Common electrical connectors for electrically and mechanically joining the stripped ends of insulated wires include wire joints, wire nuts and butt splice connectors. A wire joint includes a crimpable metallic ferrule retained in one end of an insulative housing with a skirt end of the housing extending therefrom for receiving the wires and directing them into the ferrule. A wire nut has a similar housing but uses a metallic element having an internal screw thread defining an opening of decreasing diameter. A butt splice comprises an elongate crimpable barrel and a housing having skirt portions extending from each end of the barrel.

The use of a wire joint is often preferable. For example, with respect to a butt splice connector, the wire joint requires only a single crimp, can accommodate a greater range of wire sizes and a greater number of wires, and requires less space since the wires extend unidirectionally from the joint. The wire joint also offers advantages over the wire nut in that the joint is typically less expensive, can be installed faster, offers a permanent connection, and does not require user judgement to avoid under or over tightening.

The typical method of applying wire joints includes the step of orienting a joint and placing it in the jaws of a pliers-type crimping tool. While holding the tool handles under slight pressure, the operator inserts the wires into the ferrule and squeezes the handles until the ferrule is crimped. It will be appreciated that iterative application of a number of joints becomes tedious and may result in discomfort to the user's hand.

A wire nut installation tool has been proposed for automatically applying wire nuts to the stripped ends of two or more wires. Of course, the connection provided by such a tool is not permanent and operator decision is required to set the torque applied to the wire nut. Additionally, this tool relies on the force of gravity to move the wire nuts into position for application. Thus the tool must be properly oriented to operate.

SUMMARY OF THE INVENTION

Among the several objects of the present invention may be noted the provision of an improved tool for sequentially automatically applying wire joints; the provision of such tool which positively feeds the joints so that the tool may be in any orientation as a wire joint is applied; the provision of such tool which makes a permanent splice and ejects a completed connection; the provision of such tool which is reliable in use, avoids jamming and has fast operation; and the provision of such a tool which is light in weight, has long service life and which is simple and economical to manufacture. Other objects and features of the present invention will be in part apparent and in part pointed out hereinafter in the specification and attendant claims.

Briefly the apparatus of the present invention includes feeder means for holding a supply of wire joints, a tool for applying the joints, and conveyor means for supplying the joints to the tool from feeder means. The tool includes a crimping station and first and second crimping members relatively movable between an open position and a crimping position. The tool also includes a wire joint advance means for advancing the next upstream wire joint to the crimping station as the crimping members move toward their open position.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
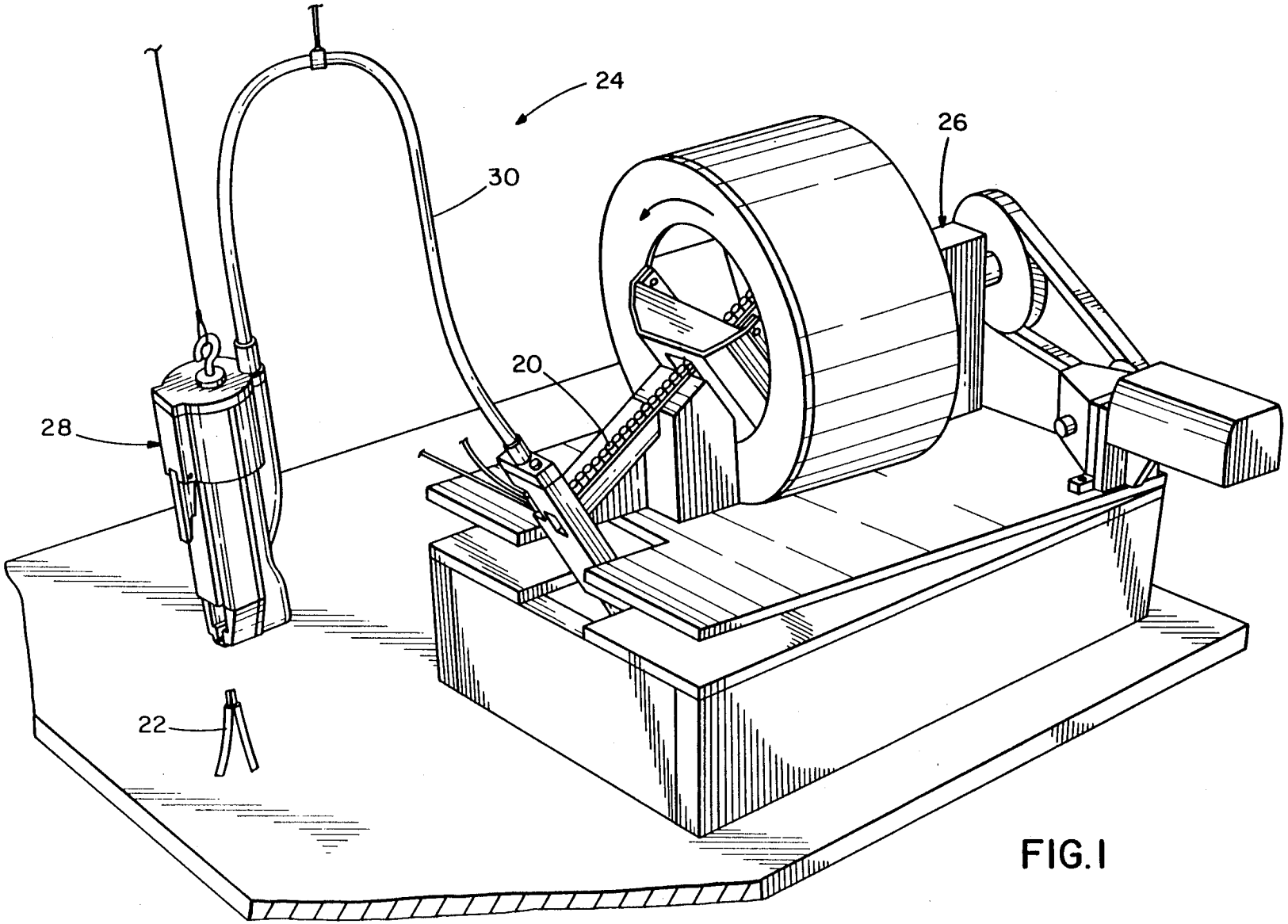
FIG. 1 is a perspective view of apparatus of the present invention for automatically applying wire joints, including a feeder holding a supply of joints, a tool for applying joints to wires by crimping, and a hose interconnecting the feeder and tool for conveying the wire joints in series.
Figure 16:
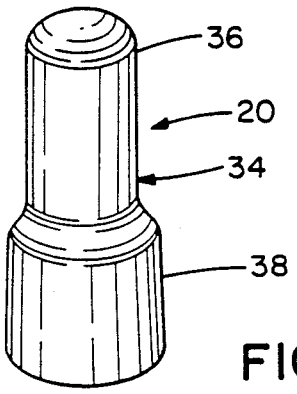
FIG. 16 is a perspective view of a wire joint for use with the present invention.
Figure 17:
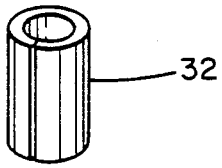
FIG. 17 is a perspective view of the wire joint ferrule.

Referring now to the drawings, apparatus for automatically applying wire joints 20 to the stripped ends of insulated conductors 22 is generally indicated in FIG. 1 by reference numeral 24. The apparatus includes feeder means 26 for holding a supply of wire joints, a tool 28, remote from feeder 26, for applying the joints by crimping and conveyor means 30 interconnecting the feeder means and tool for conveying wire joints in series. With reference to FIGS. 16 and 17, each wire joint 20 includes a crimpable metallic ferrule 32 and an insulative housing 34 comprising a ferrule retaining end 36 and an open skirt end 38 for receiving conductors 22 and directing them into ferrule 32. The skirt end of the housing extends from the ferrule end and has a greater diameter than the ferrule end. As will be explained more fully hereinafter, the feeder means 26 and conveyor means 30 function to supply the wire joints skirt end first to the tool 28.

Figure 2:
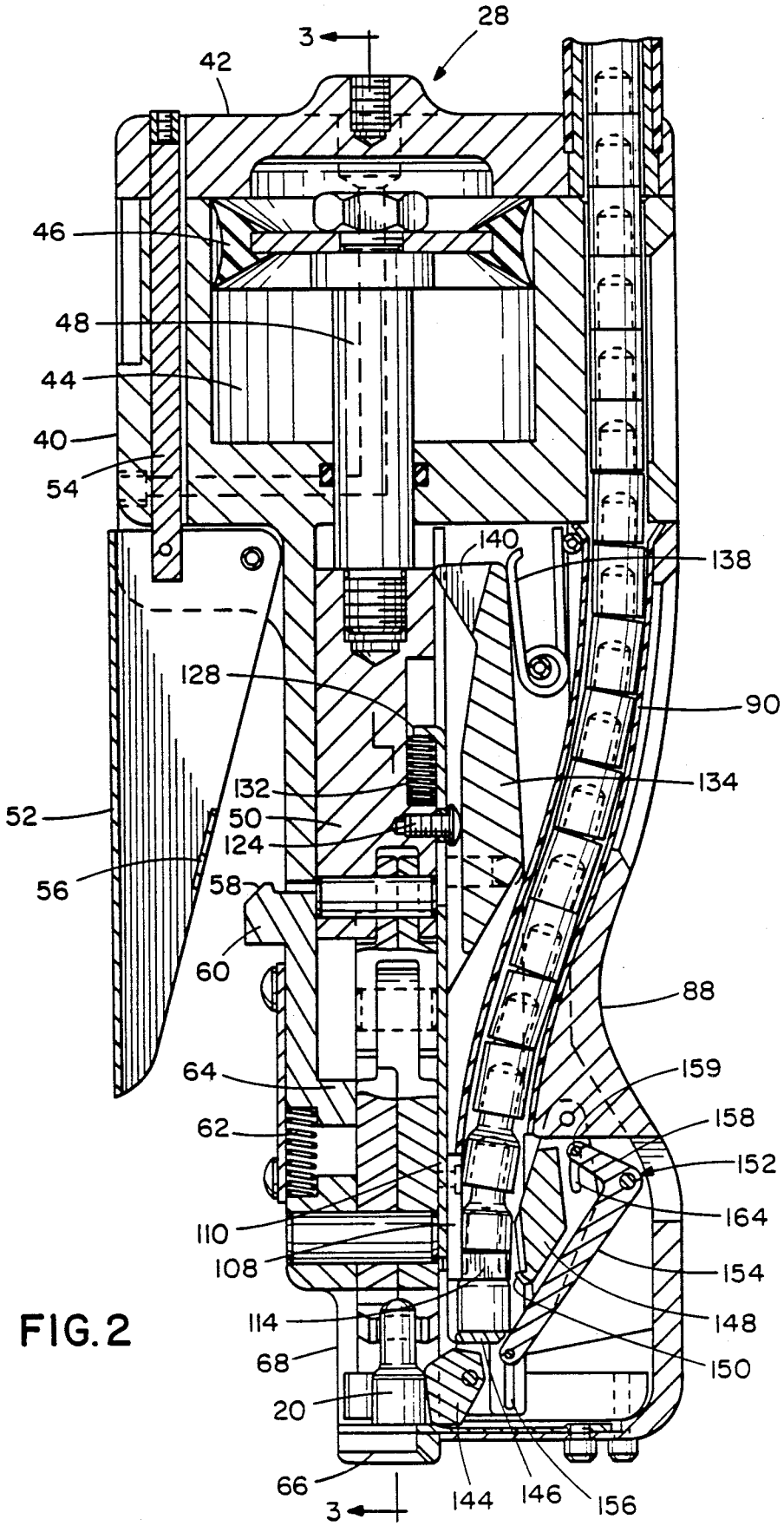
FIG. 2 is a cross-sectional view of the tool of FIG. 1 illustrating a ram connected to crimping jaws, retracted for moving the jaws to their open position.
Figure 4:
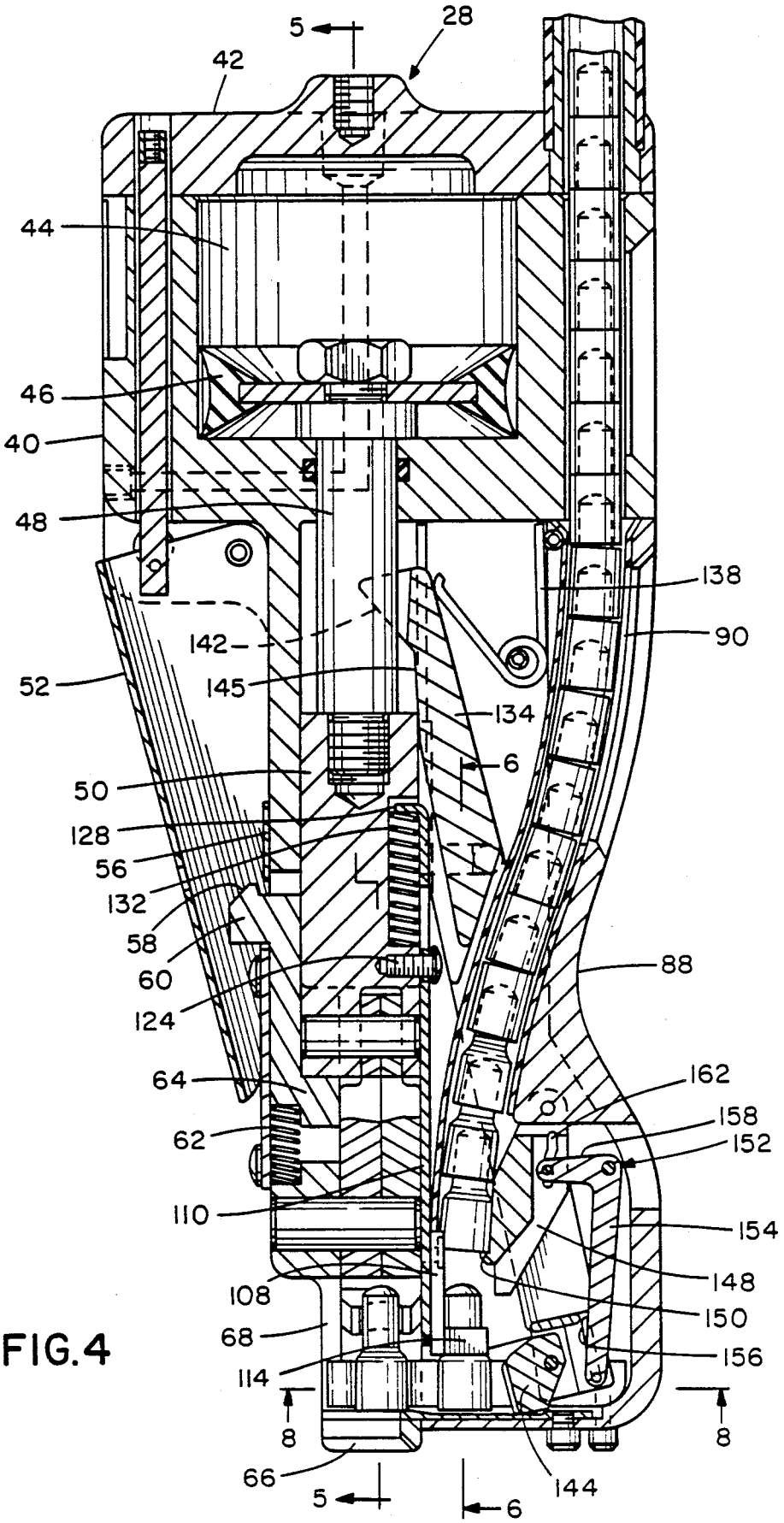
FIG. 4 is a cross-sectional view similar to FIG. 2 depicting the ram extended for moving the jaws to their crimping position.

As shown in FIGS. 2 and 4, tool 28 includes a tool body 40 and top cover 42 defining a bore 44 receiving a piston 46 having a piston rod 48 for reciprocating a ram 50. Movement of the ram is controlled by a trigger 52 which shifts a pair of three way valves by means of a valve rod 54. In the interest of brevity, the valves, air supply, air passageways and air supply connections and hardware are not fully shown as these are well known by those skilled in the art. Suffice it to say that trigger 52 is biased to a rest position, shown in FIG. 2, which causes one valve to supply air to the portion of bore 44 below piston 46 and the other valve to exhaust the portion of the bore above the piston thus causing the ram to move to, or remain in, its retracted position. Actuation of trigger 52 against the bias reverses the valves so that the upper portion of the bore is pressurized and the lower portion exhausted effecting movement of the ram to its extended position shown in FIG. 4.

Trigger 52 is pivotally mounted on the tool body 40 and carries a catch 56 for deflecting and being held by a nose 58 of a trigger lock 60 slidably retained by the tool body. Lock 60 is biased by a compression spring 62 to retain the catch thus holding trigger 52 in its actuated position. Lock 60 has an extension 64 engageable with the ram so that as the ram reaches its extended position, the lock is moved downward against spring 62 causing the release of the trigger catch 56. Thus lock 60 functions to hold trigger 52, once activated, until the ram stroke is completed insuring that the joint is fully crimped. Thereafter the trigger is released to return to its rest position resulting in retraction of the ram.

Tool 28 also includes a crimping station for holding a wire joint in position to be crimped about a plurality of wires. As shown in FIGS. 2 and 4, tool body 40 includes a window 66 for receiving wires to be spliced by the joint, and further includes an adjoining exit opening 68 for ejection of the completed termination.

Figure 3:
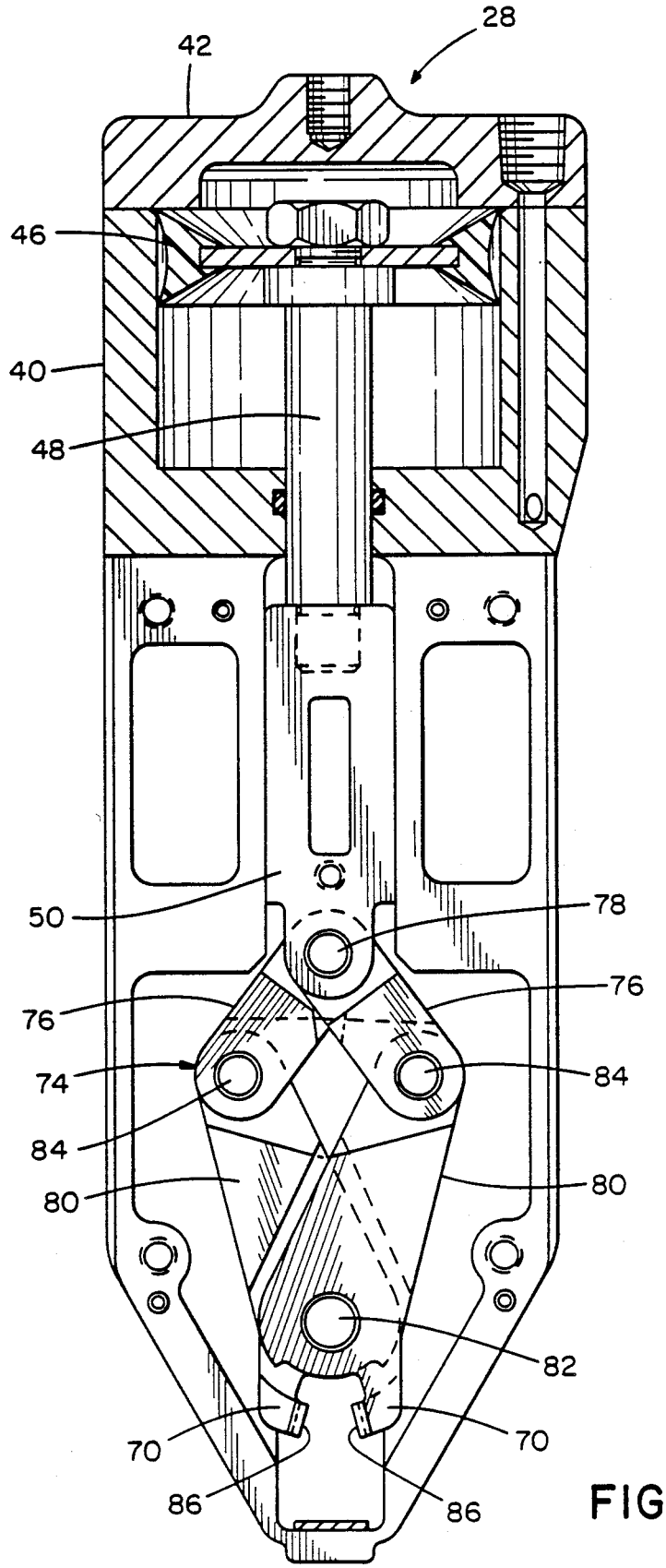
FIG. 3 is a sectional view taken generally along line 3—3 of FIG. 2 showing a power toggle interconnecting the ram and crimping jaws.
Figure 5:
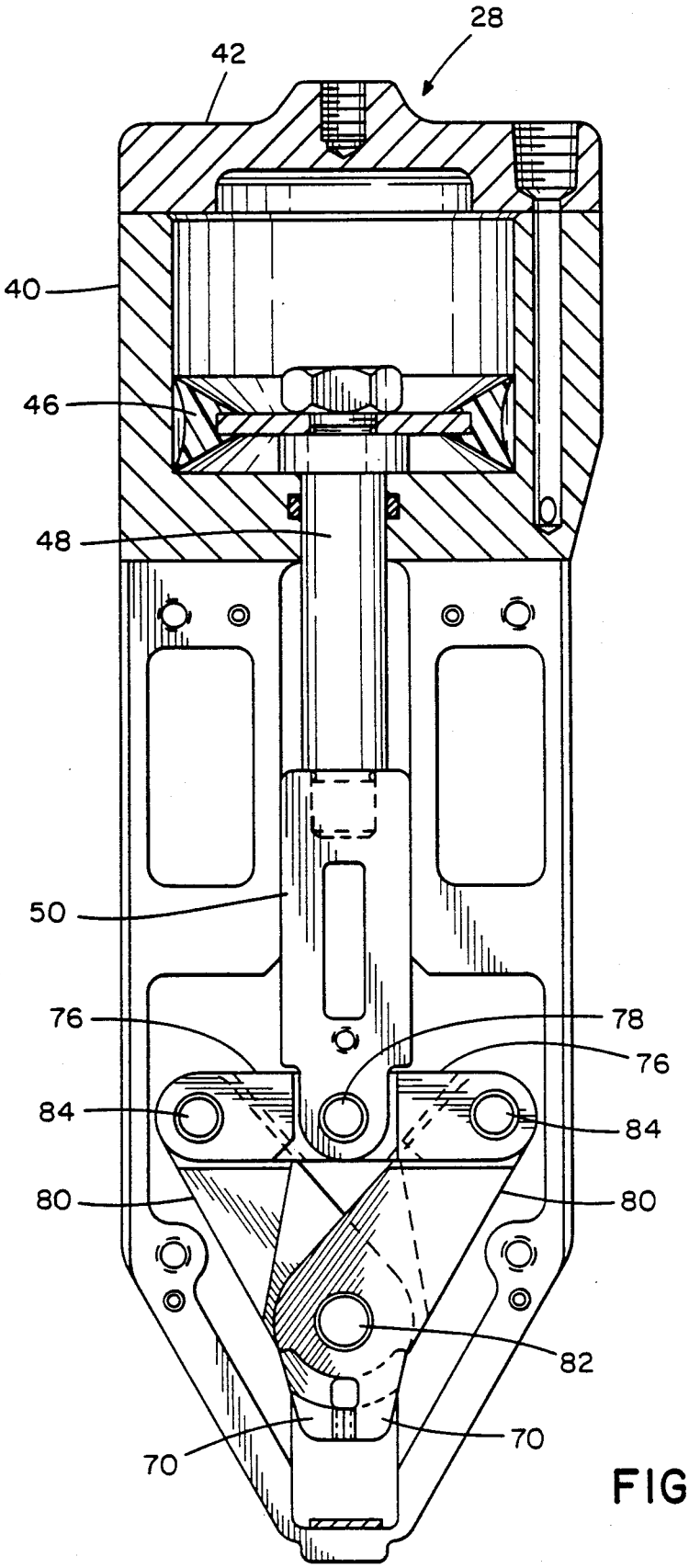
FIG. 5, similar to FIG. 3, is a sectional view taken generally along line 5—5 of FIG. 4 showing the power toggle when the ram is extended and the jaws are in their crimping position.

Referring to FIGS. 3 and 5, tool 28 also includes first and second crimping members in the form of crimping jaws 70 which are relatively movable between an open position (FIG. 3) and a crimping position (FIG. 5) for applying a wire joint held at the crimping position. Jaws 70 are connected to ram 50 by a power toggle 74 so that they are open when the ram is retracted and in their crimping position when the ram is extended. More specifically, toggle 74 includes a pair of drive links 76 having first ends pivotally connected to one another and to the ram by a floating pin 78. The toggle further comprises a pair of driven links 80 intermediately pivotally connected to one another by a pin 82 fixed to the tool body, with each driven link having a first end pivotally connected to a second end of a corresponding drive link by a floating pin 84. Each crimping jaw 70 is integral with a second end of a corresponding driven link and the jaws have facing working surfaces 86 defining a crimp which is generally oval in cross section.

Figure 8:
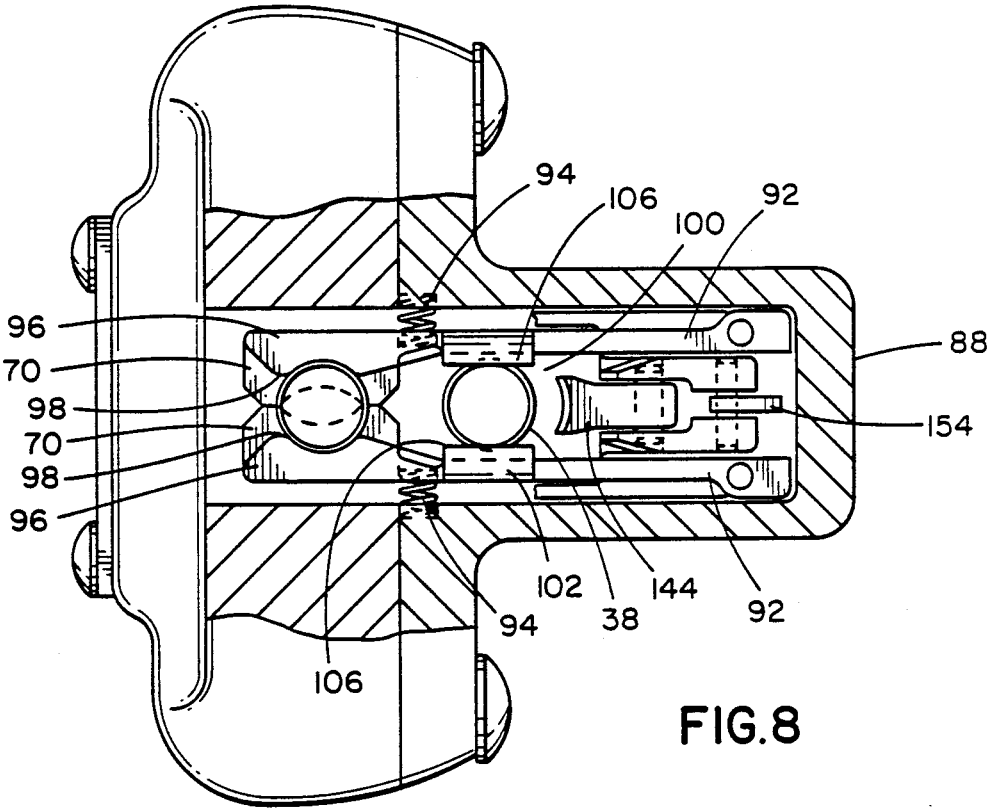
FIG. 8 is a sectional view taken generally along line 8—8 of FIG. 4 showing a wire joint held at a crimping station and another wire joint in position to be moved to the crimping station.
Figure 9:
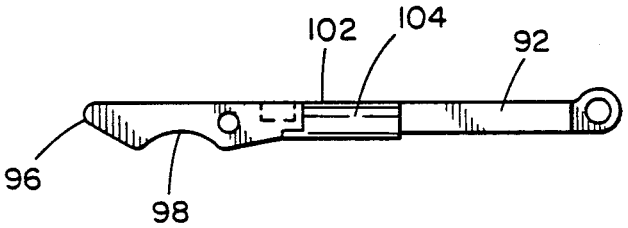
FIG. 9 is a plan view of one of the components for holding a wire joint at the crimping station and another wire joint in position to be moved to the crimping station.
Figure 10:
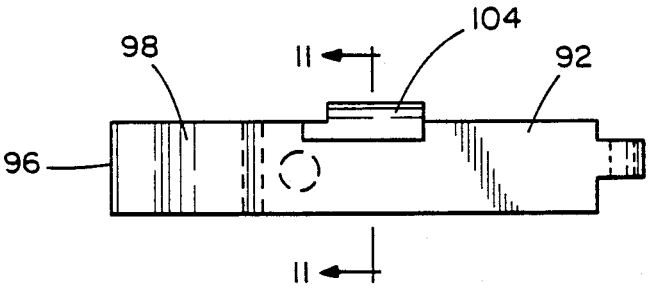
FIG. 10 is a front view of the component of FIG. 9.
Figure 11:
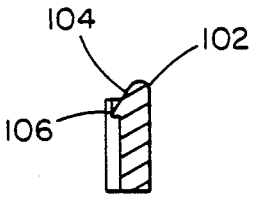
FIG. 11 is a sectional view taken generally along lines 11—11 of FIG. 10.

Attached to tool body 40 is a side cover 88 enclosing a chute 90 holding a stack of wire joints supplied by conveyor means 30, and further enclosing positive wire joint advance means responsive to crimping jaws 70 moving toward their open position to advance the next upstream wire joint to the crimping station and eject the previous wire joint applied to the conductors. Referring to FIG. 8, the advance means comprises a pair of coextensive arms 92 having first ends thereof pivotally connected to the side cover 88. The arms are biased toward one another by compression springs 94 and the distal ends 96 of the arms have facing arcuate surfaces 98 for holding the wire joint to be crimped at the crimping station. With additional reference to FIGS. 9–11, arms 92 form fixed gate means 100 for holding a wire joint in position to be transferred to the crimping station. More specifically, each arm, intermediate its ends, has an extension 102 with an inclined surface 104 adjoining a tooth 106 for holding the skirt end of a wire joint housing. The inclined surfaces face and converge in the direction of wire joint feed so a wire joint, presented skirt end first, will engage surfaces 104 causing arms 92 to deflect against the bias of springs 94. When skirt end 38 passes teeth 106 the arms will move toward one another, due to the resiliency of the springs, capturing the skirt end beneath teeth 106 where the joint will be retained in position to be transferred to the crimping station.

Figure 6:
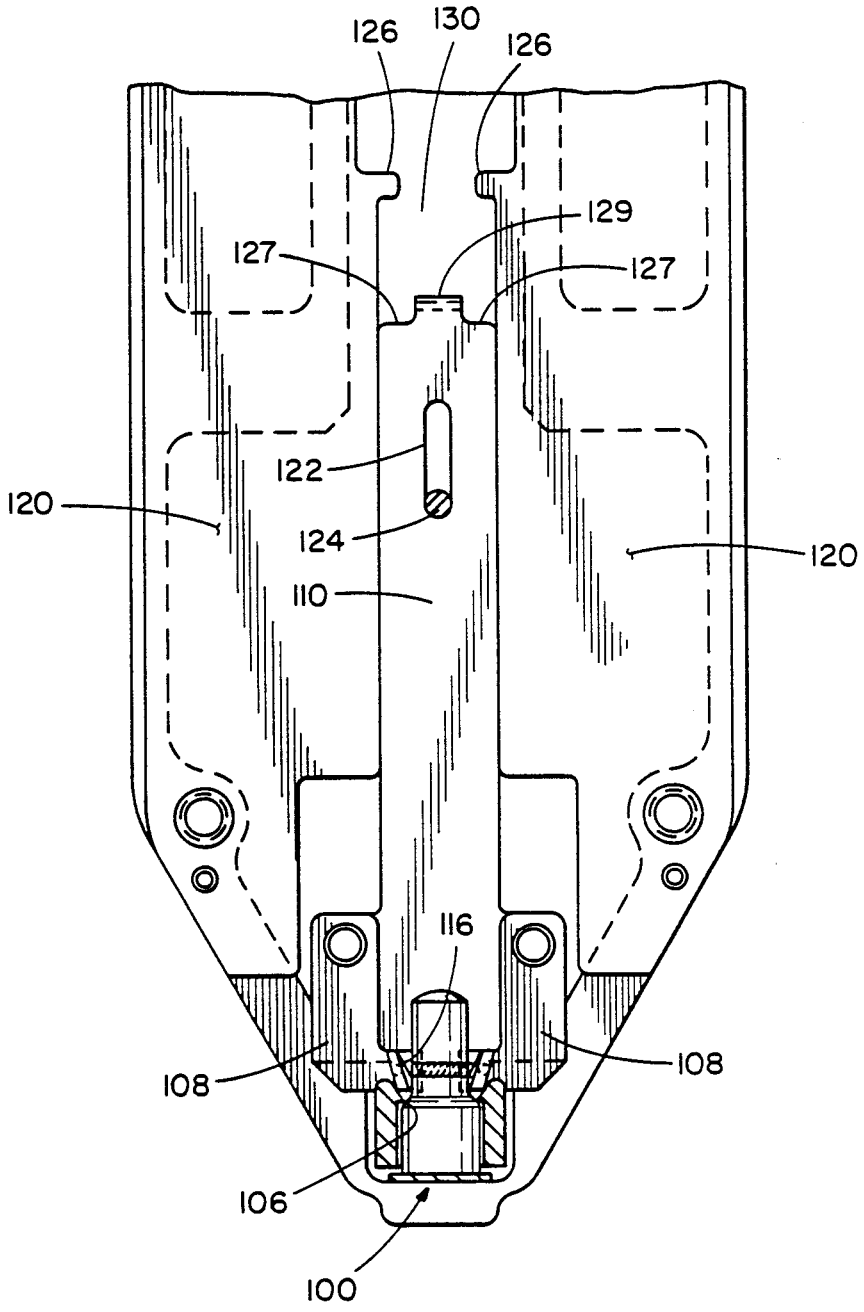
FIG. 6 is a sectional view taken along line 6—6 of FIG. 4 illustrating components of a wire joint advance mechanism when the ram is extended.
Figure 12:
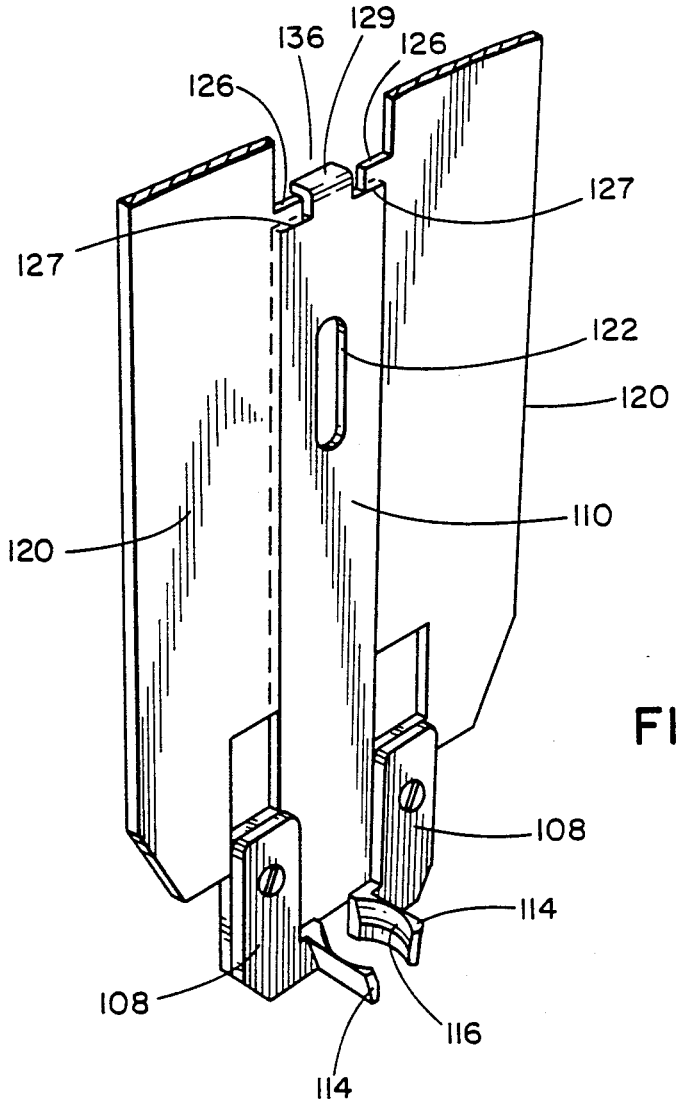
FIG. 12 is a perspective view of the slidable mounting plate and movable gate shown in FIG. 6.
Figure 13:
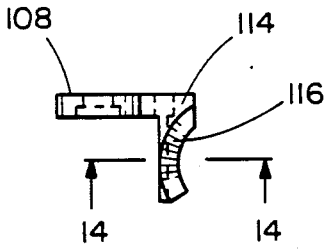
FIG. 13 is a plan view of one of the arms forming the movable gate.
Figure 14:
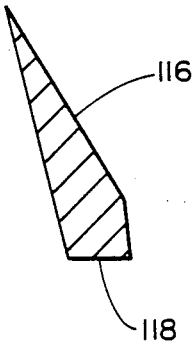
FIG. 14 is a sectional view taken generally along line 14—14 of FIG. 13.

The wire joint advance means further comprises a second or movable gate means for transferring a wire joint to the fixed gate means. Referring to FIG. 6, the movable gate comprises a pair of arms 108 pivotally connected to a slidable transfer plate 110 and biased toward each other by a spring 112. As best shown in FIGS. 13 and 14, each arm 108 has an extension 114 having an arcuate inclined ramp surface 116 and an abutment surface 118 for engaging a wire joint to be moved. Ramp surfaces 116 face one another and are shaped complimentary to the skirt end of a wire joint housing. Referring to FIGS. 6 and 12 transfer plate 110 is flanked by a pair of spacer plates 120 attached to tool body 40 and has an elongate slot 122 for receiving a fastener 124 carried by ram 50 (FIGS. 2 and 4). Spacer plates have abutments 126 for engagement with shoulders 127 to limit movement of the transfer plate away from fixed gate 100. As shown in FIGS. 2 and 4, transfer plate 110 carries a finger 128 disposed in an elongate recess 130 with a compression spring 132 positioned in the recess beneath finger 128.

Figure 7:
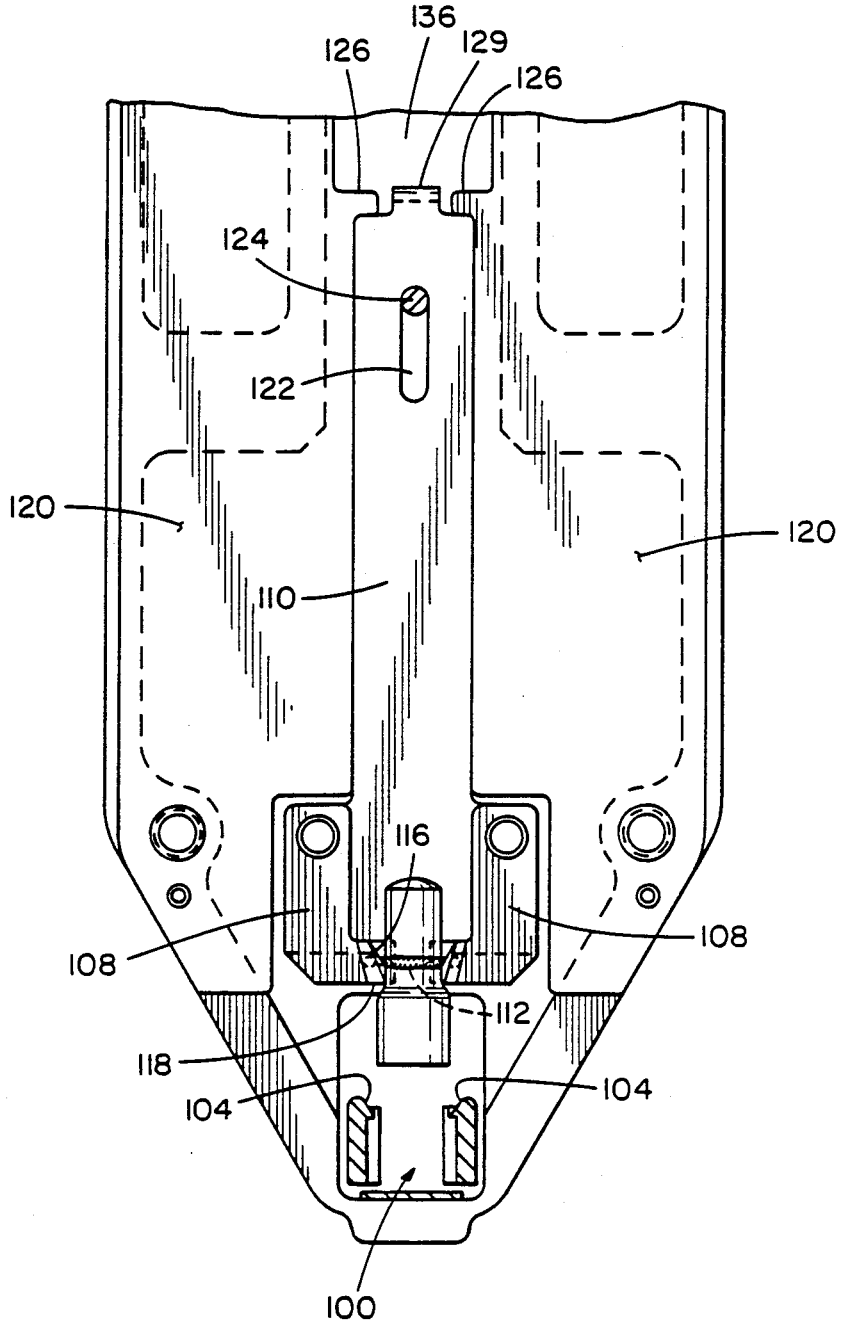
FIG. 7, similar to FIG. 6, illustrates components of the wire joint advance mechanism when the ram is retracted.

The second gate is movable between a remote position, shown in FIG. 7, wherein a wire joint is disposed between the second gate and fixed gate and a feeding position, shown in FIG. 6, in which the movable gate is adjacent fixed gate 100 and has transferred the wire joint thereto. Referring to FIGS. 4 and 6, as ram 50 moves from its extended position, transfer plate 110, due to the force applied by spring 132 on finger 128, immediately moves the second gate towards its remote position. A wire joint positioned in the upward path of the second gate engages ramp surfaces 116 causing arms 108 to deflect outwardly. Upon the second gate passing the skirt portion of that wire joint, the arms 108 pivot toward one another due to the bias of extension spring 112 where abutment surfaces 118 are positioned to engage the skirt end of the housing.

When the ram moves from its retracted position, FIG. 2, the transfer plate does not immediately move because spring 132 exerts an upwardly directed force on finger 128 causing shoulders 127 to remain in engagement with abutments 126. Movement of the second gate from its remote position is delayed until fastener 124 travels the length of slot 122. With continued movement of the ram towards its extended position, the abutment surfaces 118 engage the wire joint disposed between the gates and the joint is transferred to the fixed gate. Spring 132, finger 128 and slot 122 constitute, in part, first delay means for delaying movement of the second gate toward its feeding position.

Figure 15:
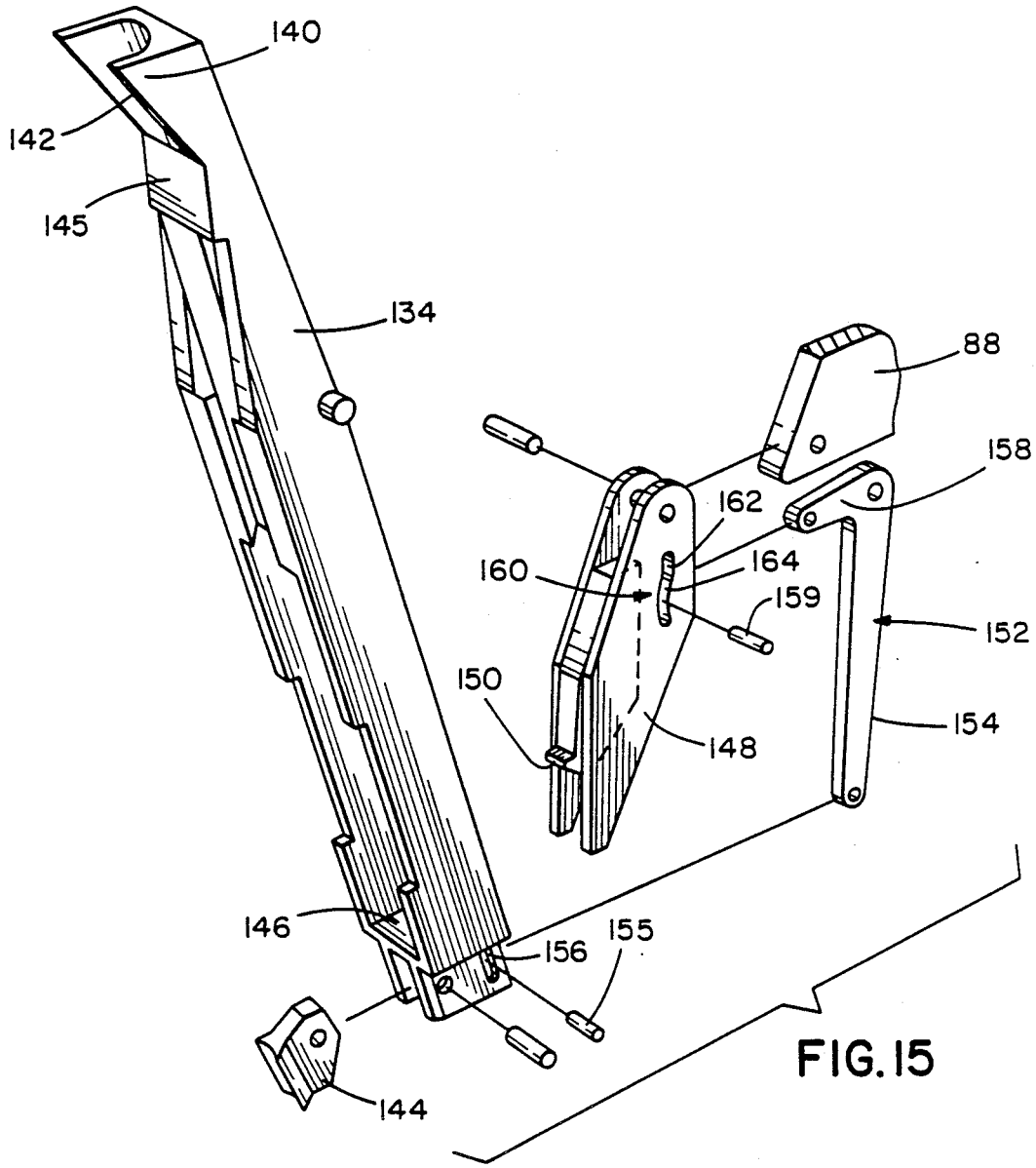
FIG. 15 is an exploded perspective of other components of the wire joint advance mechanism.

Further components of the wire joint advance means are shown in FIG. 15, in addition to FIGS. 2 and 4, and include a transfer bar 134 pivotally connected intermediate its ends to side cover 88. One end of the transfer bar extends through a window 136 defined by spacer plates 120 and is biased into engagement with ram 50 by a torsion spring 138. That end of the transfer bar terminates in nose 140 having a cam surface 142 for engaging the ram 50 as it moves to its retracted position so that in response thereto the bar 134 pivots to its position shown in FIG. 2 causing a shoe 144, carried by the lower end of the bar, to move a wire joint held by fixed gate 100 to the crimping station. Shoe 144 constitutes, in part, means for ejecting a crimped wire joint because the wire joint moved by the shoe pushes the previously crimped joint from the crimping station through exit opening 68.

Nose 140 is bifurcated and straddles piston rod 48 when ram 50 is below the level of cam surface 142. Transfer bar 134 has a planar surface 145 for slidably engaging the ram when the ram is moving below the level of nose 140. As noted before, when the ram moves from its extended position, the second gate immediately starts to move. However during the initial part of its movement from its extended position, ram 50 engages planar surface 145 and the transfer bar 134 will not pivot from its position shown in FIG. 4 until ram 50 rises to the level of cam surface 142.

The transfer bar has floor means in the form of a shelf 146 for holding a wire joint disposed between the fixed gate and the second gate when the ram is retracted. Shelf 146 is movable between a supporting position shown in FIG. 2 and a release position depicted in FIG. 4. Thus planar surface 145 constitutes, in part, second delay means for delaying movement of shelf 146, which is integral with the transfer bar, until the second gate has moved toward its remote position. To prevent advance of the entire stack of wire joints when the shelf is in its release position, the wire joint advance means further comprises stack holding means comprising a retainer 148 pivotally connected to side cover 88 and having a finger 150 for supporting the stack of wire joints when the shelf 146 is moved to its release position.

Wire joint stack retainer 148 and transfer bar 134 are interconnected by a bellcrank 152 also pivotally connected to side cover 88. One leg 154 of the bellcrank carries a pin 155 received in an elongate linear slot 156 in the lower end of the transfer bar adjacent shoe 144. The other bellcrank leg 158 carries a pin 159 received in a compound slot 160 in retainer 148. Slot 160 includes a linear portion 162 and an arcuate portion 164 which has a shape complimentary to the path travelled by the pin 159. It will be appreciated that compound slot 160 acts to delay release of the stack until after the transfer bar has moved from its position shown in FIG. 4 allowing the shoe to move a wire joint toward the crimping station and shelf 146 to move into position to support the stack of wire joints.

Figure 18:
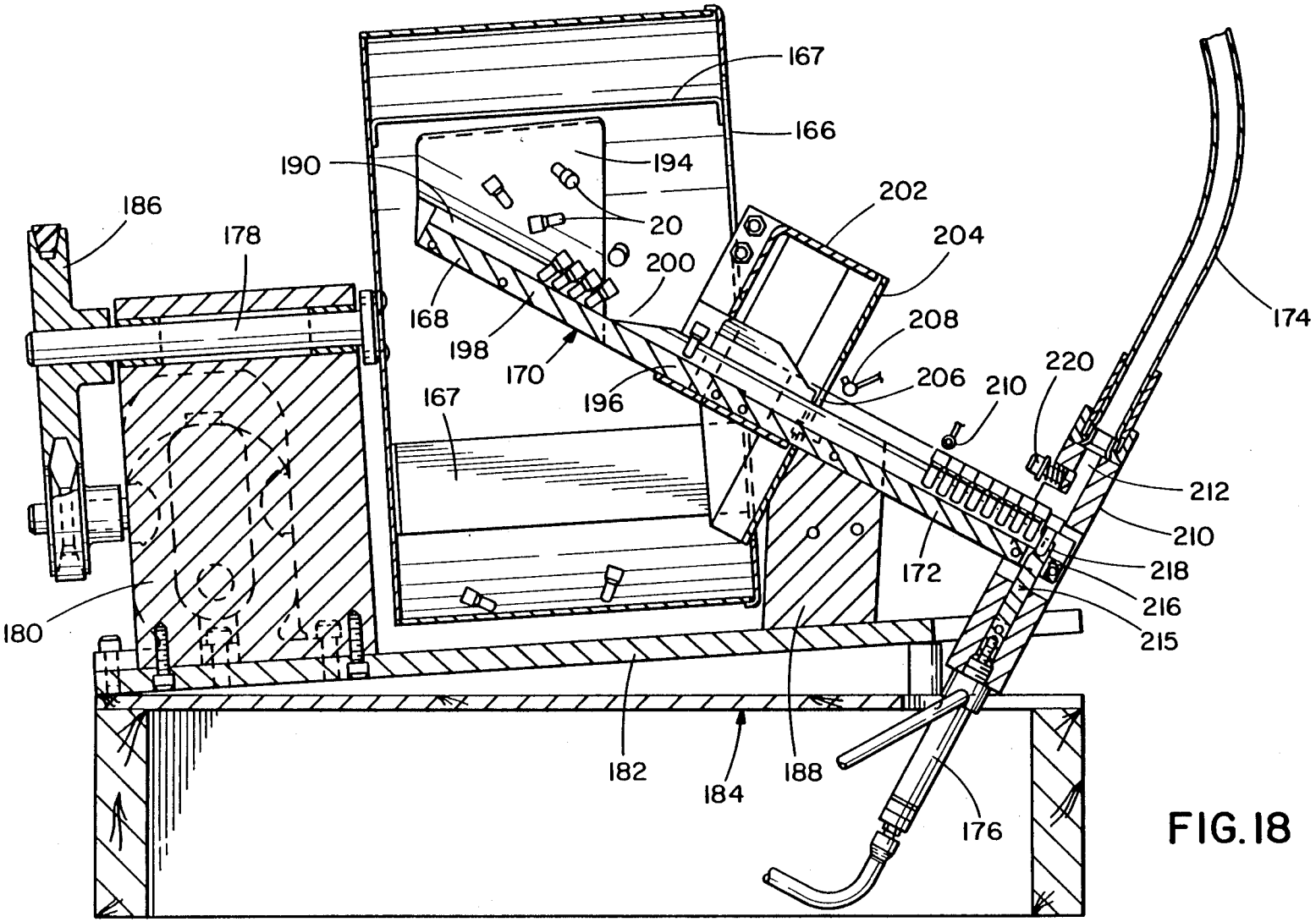
FIG. 18 is a cross-sectional view of the feeder of the present invention.
Figure 19:
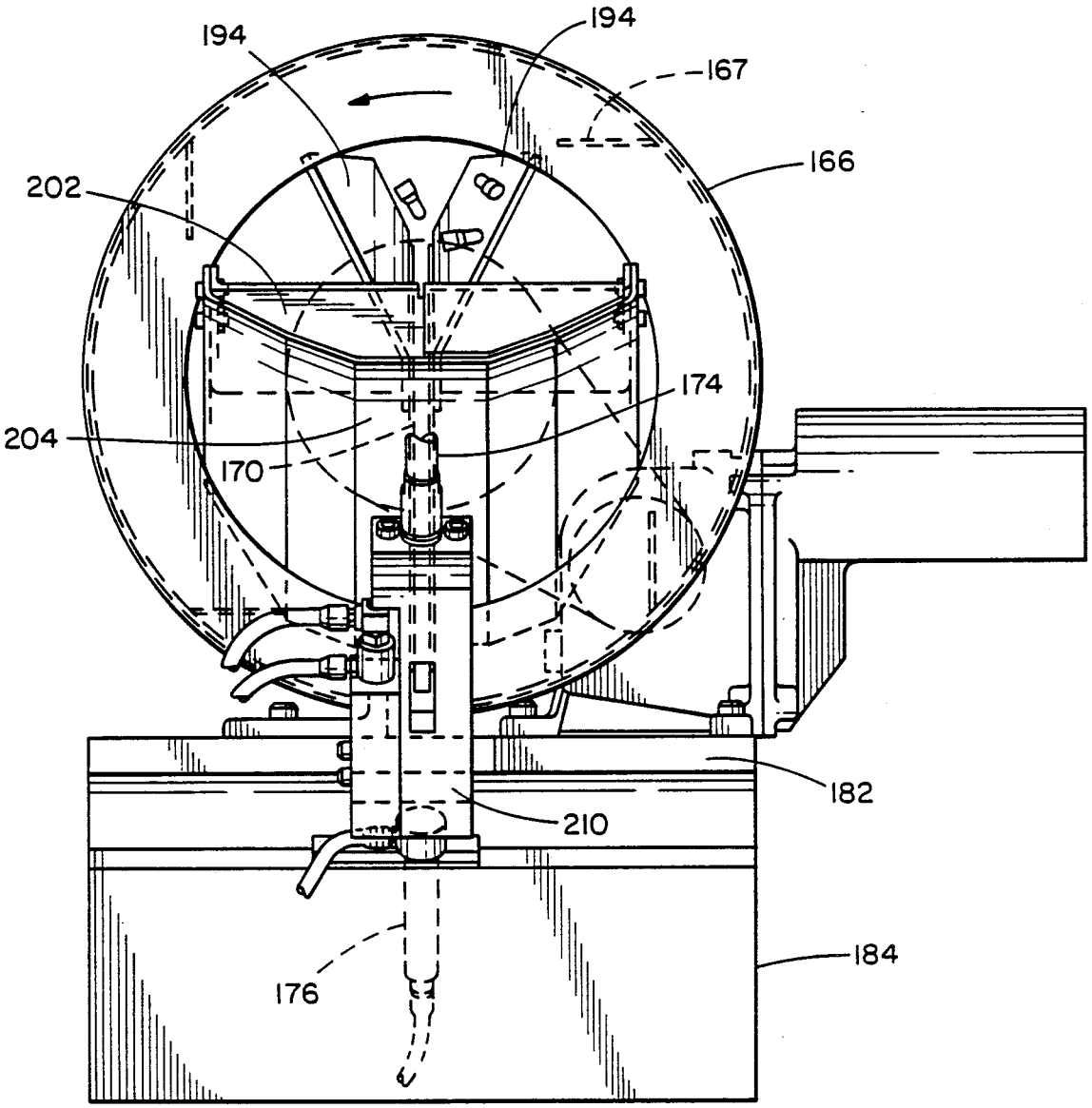
FIG. 19 is an end view of the feeder.

The wire joint feeder means 26 is best shown in FIGS. 18 and 19 and comprises a rotatable drum 166 carrying a supply of wire joints 20. The drum carries internal paddles 167 for showering the joints over the upper portion 168 of an inclined channel 170, the lower portion 172 of which positions the joints to be inserted into a conveyor hose 174 by means of an insertion air cylinder 176. Drum 166 is carried by a shaft 178 supported by a pillow block 180 mounted on an inclined top plate 182 of a table 184. A pulley 186 mounted on the shaft is driven by a gearmotor through an endless belt.

Channel 170 is also mounted on plate 182 by means of a standard 188 and has side walls 190 spaced greater than the diameter of the ferrule retaining end 36 of wire joint housing 34. However the spacing between the side walls is less than the diameter of housing skirt end 30 so that wire joints carried by the channel have their ferrule retaining ends 36 extending between the walls and their skirt ends riding on the side wall top surfaces. Besides comprising lower portion 172 joined to conveyor means 30 and upper portion 168 carrying a pair of converging wings 194 for funneling the showered wire joints toward the upper portion, the inclined channel further includes an intermediate portion 196 responsive to the lower portion being filled with wire joints to return further wire joints to drum 166.

More specifically, the channel 170 includes a floor 198 joining side walls 190. The spacing between the floor and the top of side walls 190 in the lower portion 172 of channel 170 approximates the length of the ferrule retaining end 36 of the wire joint housing. However the floor is raised in the upper and intermediate channel portions so that a wire joint positioned therein must lean with respect to the longitudinal direction of the channel. The side walls in intermediate portion 196 have escapement windows 200 for returning wire joints to the hopper should lower portion 172 be filled. Intermediate portion 196 carries a shield 202 having a front wall 204 having an aperture 206 for passage of wire joints as they travel down the channel. A first air jet 208 is positioned to dislodge a wire joint nested in another joint approaching front wall 204 and shield 202 functions to return the dislodged joint to the drum. A second air jet 210 is provided further downstream to dislodge a wire joint from the lower portion of the channel in the unlikely event the joint is riding on the side walls without the ferrule retaining end extending between the side walls. Accordingly, the inclined ramp 170 constitutes, in part, orientation means for presenting the wire joints skirt end first to conveyor means 30.

The conveyor means includes an ejector body 210 carried at the lower end of channel 170. Body 210 has a passageway 212 leading to conveyor hose 174. Channel 170 also carries cylinder 176 having a ram 215 aligned with passageway 212 extending through an opening 216 in floor 198. The ram end includes a stop 218 for positioning the leading wire joint in the channel. Cylinder 176 is interconnected with a pneumatic control circuit, shown in FIG. 20, which causes the cylinder to exert a predetermined limited force until ram 215 reaches its extended position. Upon the ram reaching its extended position, the control circuit causes the cylinder to automatically retract the ram allowing the wire joints in the channel to advance because of gravity. After the ram has retracted, the control circuit switches pressurization of cylinder 176 again causing the ram to extend.

Figure 20:
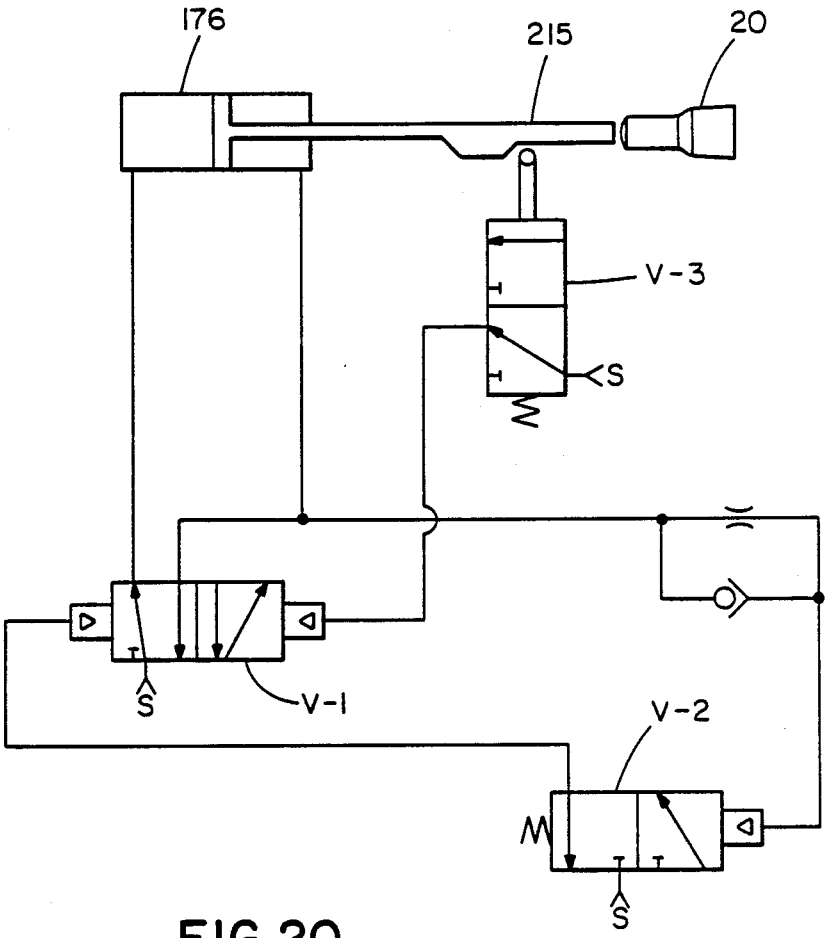
FIG. 20 is a schematic diagram of a pneumatic control circuit.

More specifically, the pneumatic control circuit of FIG. 20 includes a four way double piloted two position valve V-1 connected to the ports of cylinder 176, a three way spring return delay valve V-2 for supplying air to the left pilot of valve V-1, and a three way spring return limit valve V-3 having an actuator arm positioned to detect ram 215 reaching its extended position for supplying air to the right pilot of valve V-1. In operation and assuming the left pilot of valve V-1 has been last activated, valve V-1 supplies air to cylinder 176 causing ram 215 to extend. With ram 215 fully extended causing feeding of a wire joint 20 into the conveyor means, the actuator arm of valve V-3 is engaged causing air to be supplied to the left pilot of valve V-1. The switching of valve V-1 causes the pressurization-/exhaustion of cylinder 176 to be reversed resulting in retraction of ram 215. With the ram retracted, valve V-3 cuts off the air supply to the right pilot of valve V-1. Besides causing retraction of the ram, air from valve V-1 is supplied to the pilot of valve V-2 through a flow control providing a time delay of sufficient duration to allow ram 215 to fully retract and another wire joint to move into position to be fed by the ram. When valve V-2 switches air is supplied to the left pilot of V-1 causing that valve to again switch supply air to cylinder 176 so that the ram extends.

The ejector body carries a spring biased pin 220 extending into passageway 212 for preventing an inserted wire joint from following the ram's return to its retracted position. Thus it will be appreciated that feeder means 26 and conveyor means 30 cooperate to supply to tool 28 a series of properly oriented wire joints under positive force.

Operation of automatic wire joint installation tool 28 is as follows: With a wire joint 20 held at the crimping station and the stack of wire joints supported by shelf 146, as shown in FIG. 2, tool 28 is in condition to receive the stripped ends of two or more insulated conductors 22 to be spliced. After the conductors are inserted into the wire joint, actuation of trigger 52 results in ram 50 moving from its retracted position. As the ram starts to descend, transfer bar 134 starts to pivot causing shelf 146 to move toward its release position. It will be appreciated that bellcrank 152 also moves and, as pin 159 is disposed in linear portion 162 of compound slot 160, stack retainer 148 immediately moves so that finger 150 can catch the wire joint disposed next above the wire joint supported by shelf 146 before the shelf moves fully from its supporting position.

With continued movement of the ram, fastener 124 reaches the limit of slot 122 causing transfer plate 110 to move the second and movable gate (arms 108) from its remote position. As the shelf 146 moves to its release position, the wire joint disposed between the gates is free to be moved by the second gate so as to spread arms 92 forming fixed gate 100. When ram 50 has completed its stroke, crimping jaws 70 have crimped the ferrule of the wire joint positioned at the crimping station, the next upstream wire joint has been transferred to fixed gate 100, and trigger lock 60 has descended freeing the trigger to return to its rest position shown in FIG. 2.

Referring to FIG. 4, with pressurization/exhaustion on piston 46 reversed, ram 50 moves from its extended position resulting in immediate upward movement of transfer plate 110. As upward movement of the ram continues, transfer plate 110 carried the second gate to its position remote from fixed gate 100 and the ram engages cam surface 142 of transfer bar 134. Further movement of the ram toward its retracted position effects pivoting of bar 134 with shoe 144 moving the wire joint held in the fixed gate toward the crimping station and shelf 146 returning toward its supporting position, FIG. 2. Upon further pivoting of bar 134, bellcrank pin 159 completes its travel of arcuate portion 164 of compound slot 160. Movement of pin 159 effects pivoting of retainer 148 and, upon release of the stack by finger 150, the entire stack advances to shelf 146. In so doing, the leading joint of the stack deflects arms 108 of the second gate. Upon the ram reaching its retracted position, the crimped wire joint has been ejected through exit opening 68 by another wire joint advancing into the crimping station, and the next wire joint is retained by shelf 146 disposed between the movable and fixed gates.

Initial loading of tool 28 with wire joints is quite simple as feeder means 26 functions to fill chute 90 with a stack of wire joints held by shelf 146. One cycle of operation of the tool results in transfer of the leading wire joint from the shelf to the crimping station. As the feeding of the wire joint is positive, the tool can be used without regard to orientation. Of course, positioning of the tool would be limited with the use of a gravity feed; therefore a positive feed is utilized.

Besides the crimping station for holding the wire joint to be crimped, arms 92 also define a loading station (at fixed gate 100) for holding a wire joint to be transferred to the crimping station. Tool 28 can further be considered to comprise a stack retaining station, defined by finger 150 of retainer 148 as shown in FIG. 4, for holding the leading wire joint in the stack. The tool further has an intermediate station, formed by shelf 146 in its supporting position as shown in FIG. 2, disposed between the retaining station and the loading station. Accordingly the present invention also includes a method of feeding wire joints in an automatic wire joint installation tool comprising the steps of:

(a) moving a wire joint from the loading station to the crimping station as crimping jaws 70 move to their open position;

(b) moving a wire joint from the stack retaining station to the intermediate station as the crimping jaws move toward their open position; and (c) moving a wire joint from the intermediate to the loading station as the crimping jaws move toward their crimping position.

Accordingly another wire joint is fed to the crimping station during each cycle of operation of the crimping members.

As mentioned above, compound slot 160 acts to delay movement of retainer 148 to free the stack until the ram has nearly reached its retracted position. Thus the method of the present invention includes the further step of delaying movement of a wire joint from the stack retaining station until a downstream wire joint has been moved toward the crimping station.

In view of the above, it will be seen that the several objects of the invention are achieved and other advantageous results obtained.

As various changes could be made in the above constructions without departing from the scope and spirit of the present invention, it is intended that all matter contained in the above description shall be interpreted as illustrative and not in a limiting sense.

What is claimed is:

1. Apparatus for applying wire joints, of the type having a crimpable metallic ferrule, to the ends of wires, said apparatus comprising:

feeder means for holding a supply of said joints, a tool, remote from said feeder means, for applying said joints by crimping, and conveyor means interconnecting said feeder means and said tool for conveying said joints in series, said tool comprising a crimping station and first and second crimping members relatively movable between an open position and a crimping position for applying a joint held at said crimping station, said tool further comprising positive wire joint advance means responsive to said crimping members moving toward said open position to advance the next upstream wire joint to said crimping station without regard to the orientation of said tool, each wire joint comprising an insulative housing having a ferrule retaining end and an open skirt end extending therefrom and having a greater diameter than said ferrule retaining end, said feeder means comprising orientation means for presenting said joints skirt end first to said conveyor means.

2. Apparatus as set forth in claim 1 wherein said orientation means comprises an inclined channel having side walls joined by a floor, said channel including a lower portion joined to said conveyor means, an upper portion for receiving wire joints showered upon it and an intermediate portion responsive to said lower portion being filled with wire joints to return further wire joints to a supply of said joints.

3. Apparatus as set forth in claim 2 wherein the spacing between said side walls is greater than the diameter of the ferrule retaining end of said housing and less than the diameter of the skirt end thereof.

4. Apparatus as set forth in claim 3 wherein said intermediate portion has a raised floor for causing said wire joints to lean, the side walls in said intermediate position having windows for returning wire joints to said supply if said lower portion is saturated with said joints.

5. Apparatus as set forth in claim 2 wherein said conveyor means comprises a hose connected to said tool, and further comprises ram means connected to said lower portion of said inclined channel for filling said hose with said joints.

6. Apparatus for applying wire joints, of the type having a crimpable metallic ferrule, to the ends of wires, said apparatus comprising:

feeder means for holding a supply of said joints, a tool, remote from said feeder means, for applying said joints by crimping, conveyor means interconnecting said feeder means and said tool for conveying said joints in series, said tool comprising a crimping station and first and second crimping members relatively movable between an open position and a crimping position for applying a joint held at said crimping station, said tool further comprising positive wire joint advance means responsive to said crimping members moving toward said open position to advance the next upstream wire joint to said crimping station without regard to the orientation of said tool, said tool comprising a ram connected to said crimping members and movable between a retracted position wherein said crimping members are in their open position, and an extended position wherein said crimping members are in their crimping position, and said tool further comprising a power toggle interconnecting said ram and said crimping members, said toggle including a pair of drive links having first ends pivotally connected to one another, and to said ram, said toggle further including a pair of driven links intermediately pivotally connected to one another, each driven link having a first end pivotally connected to a second end of a corresponding drive link, each of said crimping members comprising a jaw integral with a second end of a corresponding driven link.

7. Apparatus for applying wire joints, of the type having a crimpable metallic ferrule, to the ends of wires, said apparatus comprising:

feeder means for holding a supply of said joints, a tool, remote from said feeder means, for applying said joints by crimping, conveyor means interconnecting said feeder means and said tool for conveying said joints in series, said tool comprising a crimping station and first and second crimping members relatively movable between an open position and a crimping position for applying a joint held at said crimping station, said tool further comprising positive wire joint advance means responsive to said crimping members moving toward said open position to advance the next upstream wire joint to said crimping station without regrad to the orientation of said tool, said tool comprising a ram connected to said crimping members and movable between a retracted position wherein said crimping members are in their open position, and an extended position wherein said crimping members are in their crimping position, and said advance means comprising fixed gate means for holding a wire joint in position to be transferred to said crimping station.

8. Apparatus as set forth in claim 7 wherein said advance means comprises second gate means movable between a remote position wherein a wire joint is disposed between the aforementioned two gate means and a feeding position wherein the second gate means is adjacent said fixed gate means and moves a wire joint to the fixed gate means.

9. Apparatus as set forth in claim 8 wherein said advance means further comprises transfer means for moving a joint held by said fixed gate to said crimping station in response to movement of said ram toward its retracted position.

10. Apparatus as set forth in claim 9 wherein said advance means further comprises floor means for supporting a wire joint disposed between said fixed gate means and said second gate means as said transfer means moves a joint to said crimping station, said floor means being movable between a supporting position and a release position.

11. Apparatus as set forth in claim 10 wherein said tool comprises chute means for holding a stack of wire joints supplied by said conveyor means, and further comprises means for holding said stack from advance when said floor means is in its release position.

12. Apparatus as set forth in claim 10 wherein as said ram moves toward its extended position said floor means moves towards its release position and said second gate means moves to its feeding position, said tool comprising first delay means for delaying movement of said second gate means to its feeding position until after said floor means has moved to its release position.

13. Apparatus as set forth in claim 12 wherein as said ram moves toward its retracted position said second gate means moves to its remote position and said floor means moves towards its supporting position, said tool comprising second delay means for delaying movement of said floor means to its supporting position until after said second gate means has moved toward its remote position.

14. An automatic wire joint installation tool adapted to receive a series of wire joints from a source thereof and crimp said joints on the stripped ends of insulated conductors, said tool comprising:

a crimping station for holding a wire joint;

first and second crimping members relatively movable between an open position and a crimping position for applying a joint held at said crimping station;

a ram operatively connected to said crimping members and movable between a retracted position and an extended position; and positive wire joint advance means engageable with said ram and responsive to said crimping members moving toward said open position to advance the next upstream joint to said crimping station without regard to the orientation of said tool, said advancement of the next joint serving to eject the crimped wire joint applied to the conductors.

15. A tool as set forth in claim 14 wherein said advance means comprises a transfer bar pivotally connected intermediate its ends to another component of said tool, said bar being biased into engagement with said ram, one end of said bar carrying cam means responsive to said ram moving said crimping members toward said open position to pivot said bar.

16. A tool as set forth in claim 15 wherein the other end of said bar carries shoe means for pushing a wire joint into said crimping station.

17. A tool as set forth in claim 16 further comprising a fixed gate for holding a wire joint in position to be advanced to said crimping station.

18. A tool as set forth in claim 17 further comprising a second gate for moving a wire joint to said fixed gate, said second gate being movable between a remote position wherein a wire joint is disposed between said fixed and second gates and a feeding position wherein said second gate is adjacent said fixed gate.

19. A tool as set forth in claim 18 each gate comprises a pair of deflectable arms biased to a position adjacent one another, said arms converging in the direction of wire joint feed.

20. A tool as set forth in claim 18 wherein said second gate is carried by a slidable plate responsive to said crimping members moving toward said crimping position to move said second gate to its feeding position.

21. A tool as set forth in claim 18 said transfer bar carries a movable floor having a supporting position for supporting a wire joint disposed between said fixed and second gates when said crimping members are in their open position, said floor moving to a release position when said crimping members move to said crimping position.

22. A tool as set forth in claim 21 comprising a chute for holding a stack of said joints and further comprising stack holding means for restraining movement of said stack when said floor is in its release position.

23. A tool as set forth in claim 22 wherein said stack holding means and said transfer bar are connected by a bellcrank.

24. An automatic wire joint installation tool adapted to receive a series of wire joints from a source thereof and apply said joints by crimping them on the stripped ends of insulated conductors, said tool comprising:

a crimping station for holding a wire joint;

first and second crimping members relatively movable between an open position and a crimping position for applying a joint held at said crimping station;

first gate means for holding a wire joint in position to be moved to said crimping station;

wire joint advance means responsive to said crimping members moving toward their open position to advance the wire joint held by said first gate means to said crimping station; and second and movable gate means for moving another wire joint to said first gate means as said crimping members move toward their crimping position, said fist and second gate means each including a pair of deflectable arms biased toward one another, said arms including inner surfaces that converge in the direction of wire joint feed.

25. A method of feeding wire joints in an automatic wire joint installation tool, said tool comprising:

a pair of crimping members movable relative to one another between a wire joint crimping position and an open position, a crimping station for holding a wire joint to be crimped, a chute holding a stack of wire joints biased to move toward said crimping station;

a loading station for holding a wire joint to be transferred to said crimping station, a stack retaining station for holding the leading wire joint in said stack, and an intermediate station disposed between said retaining station and said loading station; said method comprising the steps of:

moving a wire joint from said loading station to said crimping station as said crimping members move to their open position, moving a wire joint from said stack retaining station toward said intermediate station as said crimping members move to their open position, and moving a wire joint from said intermediate station to said loading station as said crimping members move toward their crimping position whereby another wire joint is fed to said crimping station during each cycle of operation of said crimping members.

26. A method of feeding wire joints as set forth in claim 25 further comprising the step of delaying movement of a wire joint from said stack retaining station until a downstream wire joint has been moved toward said crimping station.

27. Apparatus for applying wire joints to the ends of wires comprising:

feeder means for holding a supply of said joints;

a tool for applying said joints by crimping; and conveyor means, including a flexible hose, interconnecting said feeder means and said tool for conveying said joints in series, said tool comprising a crimping station and first and second crimping members relatively movable between an open position and a crimping position for applying a joint held at said crimping station, said apparatus further comprising positive wire joint advance means for advancing a subsequent wire joint to said crimping station after completion of crimping of a previous wire joint, said positive wire joint advance means including a fixed gate means for holding a wire joint in position to be tranferred to said crimping station, a second movable gate means for moving a wire joint to the fixed gate means and a transfer means for moving a wire joint held by said fixed gate means to said crimping station whereby said tool avoids the use of gravity feed and can be used in any orientation.

28. Apparatus as set forth in claim 27 wherein said tool further comprises means for ejecting a crimped wire joint.

* * * * *